US008669216B2

(12) United States Patent
Zhu

(10) Patent No.: US 8,669,216 B2
(45) Date of Patent: Mar. 11, 2014

(54) CONCENTRATED HARD SURFACE TREATMENT COMPOSITIONS

(75) Inventor: Yun-Peng Zhu, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 176 days.

(21) Appl. No.: 13/126,001

(22) PCT Filed: Sep. 8, 2009

(86) PCT No.: PCT/GB2009/002152
§ 371 (c)(1),
(2), (4) Date: Aug. 2, 2011

(87) PCT Pub. No.: WO2010/049663
PCT Pub. Date: May 6, 2010

(65) Prior Publication Data

US 2011/0278194 A1 Nov. 17, 2011

(30) Foreign Application Priority Data

Oct. 29, 2008 (GB) ..... 0819804.6

(51) Int. Cl.

| | |
|---|---|
| ***C11D 3/44*** | (2006.01) |
| ***C11D 17/04*** | (2006.01) |
| ***C11D 1/12*** | (2006.01) |
| ***B08B 7/00*** | (2006.01) |

(52) U.S. Cl.
USPC ..... 510/108; 510/296; 510/406; 510/407; 510/414; 510/426; 510/432; 510/488; 510/495; 510/499; 510/506; 134/42

(58) Field of Classification Search
USPC ..... 510/108, 296, 406, 407, 414, 426, 432, 510/495, 499, 505, 488, 506; 134/42
See application file for complete search history.

(56) References Cited

U.S. PATENT DOCUMENTS

| | | | | |
|---|---|---|---|---|
| 5,981,453 | A | 11/1999 | Faingold | |
| 6,423,677 | B1 * | 7/2002 | Van Eenam | 510/365 |
| 6,683,037 | B2 * | 1/2004 | Mondin | 510/293 |
| 6,936,579 | B2 * | 8/2005 | Urban | 510/412 |
| 2001/0009893 | A1 * | 7/2001 | Leonard et al. | 510/238 |
| 2002/0187918 | A1 * | 12/2002 | Urban | 510/505 |
| 2003/0199414 | A1 * | 10/2003 | Boutique et al. | 510/293 |
| 2004/0186035 | A1 * | 9/2004 | Johnston et al. | 510/296 |
| 2005/0065053 | A1 * | 3/2005 | De Buzzaccarini et al. | 510/295 |
| 2006/0030513 | A1 * | 2/2006 | Binder et al. | 510/515 |
| 2006/0063691 | A1 * | 3/2006 | Carlomagno et al. | 510/295 |

FOREIGN PATENT DOCUMENTS

| | | | |
|---|---|---|---|
| EP | 1 516 917 | A1 | 3/2005 |
| EP | 1 640 444 | A1 | 3/2006 |
| EP | 1 666 579 | A1 | 6/2006 |
| GB | 1 491 603 | | 11/1977 |
| WO | 01 79417 | A1 | 10/2001 |
| WO | 03 089563 | A1 | 10/2003 |
| WO | 2006 004721 | A1 | 1/2006 |
| WO | 2006 130647 | A1 | 12/2006 |

OTHER PUBLICATIONS

International Search Report issued in International Application No. PCT/GB2009/002152, mailed Dec. 7, 2009.
UK Search Report issued in Application No. GB0819804.6, mailed Feb. 27, 2009.

* cited by examiner

*Primary Examiner* — Lorna M Douyon
(74) *Attorney, Agent, or Firm* — Norris McLaughlin & Marcus PA

(57) ABSTRACT

The present invention relates to concentrated hard surface treatment compositions which are primarily intended to be dispersed in a larger volume or quantity of water prior to use by a consumer, in order to produce a ready to use type composition.

10 Claims, No Drawings

CONCENTRATED HARD SURFACE TREATMENT COMPOSITIONS

This is an application filed under 35 USC 371 of PCT/GB2009/002152.

The present invention relates to concentrated hard surface treatment compositions which are primarily intended to be dispersed in a larger volume or quantity of water prior to use by a consumer, in order to produce a ready to use type composition. In a preferred embodiment, the concentrated hard surface treatment compositions are supplied in a unit dosage form, such as in a vessel or container wherein such a unit dosage form is dissolved or dispersed into a pre-measured larger volume of water in order to form a ready to use hard surface treatment composition therefrom. In one such preferred embodiment, the unit dosage form is a quantity of the concentrated hard surface treatment composition encased in container which is at least partially water soluble, such as a water soluble pouch or sachet, or an injection molded or draw molded container or capsule at least one part of which is water soluble, but preferably all of which is water soluble. In such an embodiment, such unit dosage forms of the concentrated hard surface treatment compositions are provided into a larger volume of water, which degrades or dissolved the at least partially water soluble container, releasing the concentrated hard surface treatment composition to the water and thereby forming a ready to use hard surface treatment composition therefrom.

Certain prior art compositions comprising a concentrated hard surface cleaning composition provided in a water soluble sachet or pouch are known, including U.S. Pat. No. 6,037,319 and US 2006/0079427 A1. These prior art articles are intended to be delivered to a larger volume of water wherein the water soluble sachet containing a concentrated hard surface cleaning composition dissolve, releasing and dispersing the hard surface cleaning composition to form a ready to use hard surface treatment composition therefrom.

A technical problem plaguing this art is that the production of a concentrated hard surface treatment composition which may be stably stored in a water soluble container, such as a sachet or pouch for an extended period of time at high temperatures, all the while maintaining an attractive appearance and suffer minimal, preferably no leakage or release of the concentrated hard surface treatment composition from the water soluble container and thereafter be readily dilutable or dispersible in a larger volume of water to provide a ready to use hard surface treatment composition therefrom. The storage of such products at high temperatures, e.g., at 40° C., or even higher temperatures, for time periods in excess of several weeks has been observed to cause substantial degradation many prior art water soluble container, such as a sachet or pouch containing concentrated hard surface treatment composition. Such failures are highly undesirable as such may cause the premature failure, and/or undesired leakage of concentrated hard surface treatment composition during storage, e.g., long term storage. Such is also highly undesirable from a consumer standpoint.

It is to these and other technical problems that the compositions of the present invention are directed.

Accordingly in a first aspect of the invention there are provided dilutable concentrated hard surface treatment compositions which comprises (preferably consists essentially of):

a detersive anionic surfactant in acid form, such that the detersive anionic surfactant in acid form reacts with an alkanolamine present in the concentrated hard surface cleaning compositions to form an alkanolamine form of the detersive anionic surfactant;

an alkanolamine;

an organic solvent constituent, which preferably includes at least one glycol ether solvent, and preferably wherein the organic solvent constituent includes at least one glycol ether solvent having reduced aqueous solubility, and at least one glycol ether solvent having good aqueous solubility;

an organic acid constituent, preferably where such comprises at least one monocarboxylic or polycarboxylic organic acid, especially where such is lactic acid;

optionally but preferably a co-surfactant, preferably a nonionic cosurfactant;

optionally, one or more constituents directed to improving the aesthetic or functional features of the inventive compositions; and, water in an amount of up to 5% wt., but preferably less.

The foregoing concentrated hard surface treatment compositions are adapted to be diluted with at least an equivalent amount of water on a w/w % basis or v/v % basis, but desirably is adapted to be diluted with water in a respective weight ratio or volume ratio of dilutable concentrated hard surface cleaning composition: water of 1:2-100, preferably 1:3-100, more preferably 1:4-100, yet more preferably 1:5-100, still more preferably 1:10-100, and most preferably 1:16-85. Such aqueous dilutions of the hard surface cleaning compositions are useful as ready to use hard treatment compositions which may be directly applied to hard surfaces in need of treatment.

According to a second aspect of the invention there is provided an aqueous diluted concentrated hard surface cleaning composition as described with reference to the first aspect of the invention which is useful as a ready to use hard surface treatment composition.

According to a third aspect of the invention there is provided a diluted concentrated hard surface cleaning composition according to the first or second aspects of the invention which also provides a disinfecting and/or germicidal and/or sanitizing benefit to hard surfaces treated with the said cleaning composition.

In a fourth aspect, the present invention provides a process for the cleaning treatment, of hard surfaces which process contemplates the application to such a hard surface in need of a cleaning treatment a cleaning effective amount of the foregoing diluted or undiluted concentrated hard surface cleaning composition as described with reference to the first aspect of the invention.

In a fifth aspect, the present invention provides a process for the cleaning treatment and disinfecting and/or sanitizing of hard surfaces which process includes the step of applying to such a hard surface in need of a cleaning treatment a cleaning effective amount of the foregoing diluted or undiluted concentrated hard surface cleaning composition as described with reference to the first aspect of the invention.

In a sixth aspect of the invention there is provided a dilutable concentrated hard surface treatment composition which is provided in a water soluble container, such as in a water soluble pouch or water soluble sachet.

These and further aspects of the invention will be better understood from the present specification.

The compositions of the invention necessarily include a detersive anionic surfactant in acid form, such that the detersive anionic surfactant in acid form reacts with an alkanolamine present in the concentrated hard surface cleaning compositions. Examples of anionic surfactants include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof.

Further examples of anionic surfactants include water soluble acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), and x is an integer, preferably 1 to 3, most preferably 1. Materials sold under the Hostapur and Biosoft trademarks are examples of such anionic surfactants.

Further examples of anionic surfactants include alkyl-diphenyl-ethersulphonates and alkyl-carboxylates. Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates (containing up to 10 moles of ethylene oxide); alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-$ wherein R is a $C_8$-$C_{22}$ alkyl, k is an integer from 0 to 10. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678 to Laughlin, et al. at column 23, line 58 through column 29, line 23, the contents of which are herein incorporated by reference.

As noted previously, the detersive anionic surfactant is provided to the composition in acid form, such that the detersive anionic surfactant in acid form reacts with an alkanolamine present in the concentrated hard surface cleaning compositions to form an alkanolamine form of the detersive anionic surfactant. Thus it is required that the detersive anionic surfactant reactive with the alkanolamine include at least one reactive acid moiety which will react, in situ, with the alkanolamine constituent present in the composition.

A preferred class of anionic surfactants in acid form which react with the alkanolamine present include linear alkylbenzene sulfonic acids; preferred resulting anionic surfactants which are formed in situ include: monoethanolamine dodecylbenzene sulfonate, diethanolamine dodecylbenzene sulfonate, triethanolamine dodecylbenzene sulfonate, morpholinium dodecylbenzene sulfonate, isopropylamine dodecylbenzene sulfonate, isopropylamine decyl diphenyloxide disulfonate. Particularly preferred detersive anionic surfactant in acid form are anionic surfactants comprising at least one benzyl group in their structure, such as alkylbenzene sulfonic acid and isopropylamines of linear alkylbenzene sulfonic acid.

The detersive anionic surfactant formed from the in situ reaction of the detersive anionic surfactant in acid form reacted with an alkanolamine is present in the concentrated hard surface treatment compositions is advantageously present in the concentrated hard surface treatment compositions an amount of from about 0.001-50% wt., more preferable from 0.01-30% wt., more preferably at least (in order of increasing preference) 1%, 2%, 3%, 4%, 5%, 6%, 7%, 8%, 9% and 10% by weight based on the total weight of the concentrated hard surface treatment compositions of which it forms a part. Likewise, preferably the detersive anionic surfactant in acid form is present in amount of not more than (in order of increasing preference) 30%, 28%, 26%, 25%, 24%, 22%, 20%, 19%, 18%, 17%, 16%, 15% by weight based on the total weight of the concentrated hard surface treatment compositions of which it forms a part. The identity of, and amount of particularly preferred detersive anionic surfactant in acid form which reactive with an alkanolamine present in the concentrated hard surface treatment compositions is described with reference to the Examples.

The concentrated hard surface treatment compositions of the invention necessarily include an alkanolamine constituent. The alkanolamine constituent necessarily reacts with the detersive anionic surfactant in acid form and provides a counterion to the acid form of the detersive anionic surfactant which occurs in situ when concentrated hard surface treatment compositions is formed or following the formation of the concentrated hard surface treatment compositions The alkanolamine constituent may also provide alkalinity to these compositions, as well as simultaneously providing excellent removal of hydrophobic soils which may be encountered, e.g., greases and oils. Exemplary useful alkanolamines include monoalkanolamines, dialkanolamines, trialkanolamines, and alkylalkanolamines such as alkyl-dialkanolamines, and dialkyl-monoalkanolamines. The alkanol and alkyl groups are generally short to medium chain length, that is, from 1 to 7 carbons in length. For di- and trialkanolamines and dialkyl-monoalkanolamines, these groups can be combined on the same amine to produce for example, methylethylhydroxypropylhydroxylamine. One of skill can readily ascertain other members of this group. The alkanolamine constituent may be a single alkanolamine, or may be a plurality of alkanolamines as well.

Particularly preferred as the alkanolamine constituent is monoethanolamine which has found to be effective both as an alkalinity source and as a cleaning component. In certain particularly preferred embodiments the alkalinity constituent of the invention consists solely of a single alkanolamine, preferably selected from monoalkanolamines, dialkanolamines, trialkanolamines of 1 to 7 carbons in length, preferably is a single monoalkanolamine selected from linear monoethanolamine, monopropanolamine or monobutanolamine, and especially preferably is monoethanolamine.

Desirably the alkanolamine constituent is present in the concentrated hard surface treatment compositions of the invention in amounts of from about 0.01%-10% by weight, more desirably from about 0.1%-5% by weight, and most preferably from about 0.5-4% wt. based on the total weight of the concentrated hard surface treatment compositions of which they form a part.

The present inventor has surprisingly found that the provision of the alkanolamine constituent with the detersive anionic surfactant in acid form permits for reaction of these two compounds and the alkanolamine constituent at least partially substitute the counterions of the detersive anionic surfactant when provided in a salt form, or provides a counterion of the detersive anionic surfactant when provided in free acid form. Such reaction provides a counterion to the acid form of the detersive anionic surfactant which reaction occurs in situ when concentrated hard surface treatment compositions is formed or following the formation of the concentrated hard surface treatment compositions. Advantageously such provides for the in situ production of anionic surfactant compounds which are formed without the production of water within the concentrated hard surface treatment compositions which is advantageous when the concentrated hard surface treatment compositions are provided and encased in container which is at least partially water soluble, such as a water soluble pouch or sachet, or an injection molded or draw molded container or capsule at least one part of which is water soluble, but preferably all of which is water soluble.

The concentrated hard surface treatment compositions of the invention necessarily includes an organic solvent constituent, which preferably includes at least one glycol ether solvent, and especially preferably includes two or more glycol ether solvents preferably wherein the organic solvent constituent includes at least one glycol ether solvent having reduced aqueous solubility, and at least one glycol ether solvent having good aqueous solubility.

Exemplary glycol ethers which may form part or all of the organic solvent constituent include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units.

In other preferred embodiments the organic solvent constituent of the concentrated hard surface treatment compositions necessarily comprises a dual-solvent system which comprises each of phenyl containing glycol ether solvents especially propylene glycol phenyl ether, and dipropylene glycol n-butyl ether. Preferably said dual-solvent system is present to the exclusion of other organic solvents, such as organic alcohols, glycols as well as glycol ethers other than the glycol phenyl ether and dipropylene glycol n-butyl ether.

In certain further preferred embodiments the organic solvent constituent of the concentrated hard surface treatment compositions of the invention include at least one glycol ether solvent having reduced aqueous solubility, and at least one glycol ether solvent having good aqueous solubility. The at least one glycol ether solvent having reduced aqueous solubility desirably exhibits a solubility in water of between 0.0-20.0 ml (glycol ether solvent)/100 ml (water), while the at least one glycol ether solvent having good aqueous solubility desirably exhibits a solubility in water of at least about 85 ml (glycol ether solvent)/100 ml (water) or even greater, i.e., approaching or demonstrating "infinite solubility". By way of non-limiting example, glycol ether solvents having reduced aqueous solubility include: propylene glycol methyl ether acetate, dipropylene glycol methyl ether acetate, propylene glycol n-butyl ether, dipropylene glycol n-butyl ether, tripropylene glycol n-butyl ether, propylene glycol phenyl ether, dirpropylene glycol n-propyl ether, and ethylene glycol phenyl ether. By way of non-limiting example, glycol ether solvents having good aqueous solubility include: propylene glycol methyl ether, dipropylene glycol methyl ether, tripropylene glycol methyl ether, propylene glycol n-propyl ether, ethylene glycol n-butyl ether, di ethylene glycol n-butyl ether, triethylene glycol n-butyl ether, diethylene glycol methyl ether, triethylene glycol methyl ether.

When the organic solvent constituent of the concentrated hard surface treatment composition includes at least one glycol ether solvent having reduced aqueous solubility, and at least one glycol ether solvent having good aqueous solubility, advantageously the w %/w % (or vol %/vol %) ratio of the at least one glycol ether solvent having reduced aqueous solubility: at least one glycol ether solvent having good aqueous solubility is 1:1-50, preferably 1:1.1-50, and in order of increasing preference is 1:1.2-50, 1:1.3-50, 1:1.4-50, 1:1.5-50, 1:1.75-50, 1:2-50, 1.25-50, 1.5-50. Such concentrated hard surface treatment compositions have been observed to exhibit good stability under adverse storage conditions, retain good transparency when included in a concentrated hard surface treatment composition following such adverse storage conditions, and when the concentrated hard surface treatment composition containing such pair of glycol ethers in a larger volume of water, the resultant ready to use hard surface treatment compositions are found to have good stain removal properties, especially removal of greasy (oleophilic) stains on hard surfaces.

The concentrated hard surface treatment compositions further necessarily includes an organic acid constituent, preferably where such comprises at least one monocarboxylic or polycarboxylic organic acid. Such may be any monocarboxylic acid, or polycarboxylic acid, whether saturated or unsaturated, that is soluble in water and has a negative log of the dissociation constant ($pK_a$), measured at 25° C. equal to or greater than 1.8. The organic acid constituent may be a compound having the formula:

R—COOH wherein R is hydrogen, lower alkyl; substituted lower alkyl; hydroxy lower alkyl; carboxy lower alkyl; carboxy, hydroxy lower alkyl; carboxy, halo lower alkyl; carboxy, dihydroxy lower alkyl; dicarboxy, hydroxy lower alkyl; carboxy lower alkenyl; dicarboxy lower alkenyl; phenyl; substituted phenyl, wherein substituted lower alkyl is substituted by one or more groups consisting of halogen, hydroxyl, amino, thiol, nitro, and cyano.

Representative examples of such acids are monocarboxylic acids such as formic acid, acetic acid, chloroacetic acid, lactic acid, ascorbic acid; dicarboxylic acids such as fumaric acid, malonic acid, succinic acid, glutaric acid, itaconic acid, tartaric acid; tricarboxylic acids such as citric acid; said acids may be used singly or as admixtures thereof. In the concentrated hard surface treatment composition, the $pK_a$ constant of the organic acid constituent will be at least 1.8 or more, preferably at least 2.0 or more, but preferably will not be greater than 7, preferably will not be greater than 6.

A particularly preferred organic acid constituent is lactic acid which in particularly preferred embodiments is necessarily present in the organic acid constituent, In certain preferred embodiments lactic acid comprises at least 50% wt., preferably at least (in order of increasing preference) 55%, 60%, 65%, 70%, 75%, 80%, 85%, 90%, 95% to 100% wt. of the organic acid constituent; the remaining balance of the organic acid constituent may be comprised of one or more further organic acids, especially organic acids selected from citric acid, glycolic acid, acetic acid, fumaric acid, succinic acid, and the like, which exhibit $pK_a$ values in the ranges, preferably within the preferred ranges given above.

The organic acid constituent comprises between 25% wt. and 75% wt., of the concentrated hard surface treatment compositions of which it forms a part. Preferably the organic acid constituent comprises (in order of increasing preference) at least 25%, 26%, 27%, 28%, 29%, 30%, 31%, 32%, 33%, 34%, 35% by weight of the concentrated hard surface treatment compositions Similarly, preferably the organic acid constituent comprises (in order of increasing preference) not more than 75%, 70%, 65%, 60%, 55%, 50%, 45%, 40%, 39%, 38%, 37%, 36%, and 35% by weight of the concentrated hard surface treatment compositions.

The concentrate compositions of the invention are acidic in nature, and desirably exhibit a pH of not more than 7, preferably not more than 5. Yet more preferably exhibit a pH of at least 0.5, and in order of increasing preference exhibit a pH of at least 0.75, 1, 1.25, 1.5, 1.75, 2, 2.25, 2.5, 2.75 and 3. Concurrently the concentrate compositions of the invention exhibit a pH of about 5 or less, and in order of increasing preference, exhibit a pH of in order of increasing preference of 4.75, 4.5, 4.25, 4, 3.75, 3.5, 3.25, or less. Typically the organic acid constituent present as an essential constituent of the concentrated hard surface treatment compositions imparts sufficient acidity to the said compositions, and further imparts sufficient acidity to aqueous dilutions of the concentrate compositions such that they also exhibit an acidic pH, preferably a pH of at 7 or less, and especially preferably a pH of about 4 or less.

In certain embodiments the concentrated hard surface treatment compositions of the invention, particularly wherein the concentrated hard surface treatment compositions is provided in a water soluble container, such as a sachet or pouch particularly where such includes a polyvinyl alcohol the construction of the container, inorganic acids are necessarily absent from the concentrated hard surface treatment compositions The inventor has observed that inorganic acids are typically unduly strong and act to prematurely degrade the polyvinyl alcohol of the water soluble container which often leads to a loss of storage stability, e.g., premature leaking, cracking or other failure of the water soluble container containing a concentrated hard surface treatment compositions including such an inorganic acid. Thus, in certain particularly preferred embodiments the compositions of the invention expressly exclude inorganic acids including: sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid. Other water dispersible or water soluble inorganic or mineral acids not specifically eludicated herein are also desirably excluded from certain preferred embodiments of the inventive compositions.

The concentrated hard surface treatment compositions are desirably formed without the addition of water, although the presence of water which may be supplied as a carrier or solvent in one or more of the constituents may be present in the concentrated hard surface treatment compositions of the invention. Preferably however, the total amount of water present in the concentrated hard surface treatment compositions is not more than 5% wt., but more preferably (in order of increasing preference) is not more than 4.8%, 4.6%. 4.5%, 4.4%, 4.2%, 4%, 3.8%, 3.6%, 3.5%, 3.4%, 3.2%, 3%, 2.8%, 2.6%, 2.5%, 2.4%, 2.2%, 2.0%, 1.8%, 1.6%, 1.5%, 1.4%, 1.2%, 1%, 0.9, 0.8%, 0.7%, 0.6%, 0.5%, 0.4%, 0.3%, 0.2%, 0.1% and 0%.

The compositions of the invention may, as a co-surfactant constituent, include a detersive nonionic surfactant based on an alcohol alkoxylate, preferably based on one or more alcohol alkoxylates. Especially preferably the detersive nonionic surfactant based on an alcohol alkoxylate comprises, more preferably consists of, a $C_9$-$C_{11}$ alcohol ethoxylate having between 6-9 moles of ethoxylation.

Useful as the detersive nonionic surfactant based on alcohol alkoxylates are a variety of nonionic surfactants known to the art. Such include, nonionic surfactants produced as the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 18 carbon atoms). Other examples are those $C_6$-$C_{18}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a C8-10 having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol®ON 110). Other examples of ethoxylated alcohols include the Neodol® series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further members of the Neodol® series including those of the Neodol® 25 series as well as the Neodol® 45 series are of particular interest, and include, inter alia, Neodol® 25-9 described as $C_{12}$-$C_{15}$ ethoxylated alcohols with about 9 ethoxy groups per molecule and Neodol® 45-7 described as $C_{14}$-$C_{15}$ ethoxylated alcohols with about 7 ethoxy groups per molecule. Other members of the Neodol® series of ethoxylated alcohols are also considered to be particularly suitable for use in the compositions of the present invention and are in certain instances, examples of preferred nonionic surfactants. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_n$ H where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants which find use as the alcohol alkoxylate include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Charlotte, N.C.) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol®UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Most preferably the alcohol alkoxylate includes a detersive nonionic alcohol ethoxylate surfactant is a $C_9$-$C_{11}$ alcohol ethoxylate having between 6-9 moles of ethoxylation. Such a material is commercially available as Lutensol® XP 79 (ex. BASF). In certain preferred embodiments the detersive nonionic alcohol ethoxylate surfactant is a $C_9$-C11 alcohol ethoxylate having between 6-9 moles of ethoxylation is the sole nonionic alcohol alkoxylate surfactant present in the inventive compositions.

When present, the detersive nonionic surfactant based on an alcohol alkoxylate is advantageously present in the concentrated hard surface treatment compositions an amount of from about 0.001-60% wt., more preferably from 0.01-30% wt., and yet more preferably 5-25% wt. based on the total weight of the concentrated hard surface treatment compositions of which they form a part. Particularly preferred amounts of the surfactants are described with reference to the Examples. In certain particularly preferred embodiments of the invention a detersive nonionic surfactant is necessarily present in the concentrated hard surface treatment compositions of the invention.

The concentrated hard surface treatment compositions may include up to about 5% wt. of one or more additional constituents which are usually directed to improving the aesthetic or functional features of the inventive compositions. By way of non-limiting example, such further optional constituents include: coloring agents, fragrances and fragrance solubilizers, pH adjusting agents and pH buffers including organic and inorganic salts, one or more further surfactants as co-surfactants, optical brighteners, opacifying agents, hydrotropes, preservatives, and anti-corrosion agents. When one or more of the optional constituents is added, i.e., fragrance and/or coloring agents, the esthetic and consumer appeal of the product is often favorably improved. The use and selection of these optional constituents is well known to those of ordinary skill in the art. When present, the total amount of the one or more optional constituents present in the inventive concentrate compositions do not exceed about 20% wt., preferably do not exceed 15% wt. based on the total weight of the concentrate compositions of which they form a part.

The concentrate compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Fragrance compositions as received from a supplier may be provided as an aqueous or organically solvated composition, and may include as a hydrotrope or emulsifier a surface-active agent, typically a surfactant, in minor amount, generally not in excess of about 1.5% wt. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Further optional, but advantageously included constituents are one or more coloring agents which find use in modifying the appearance of the compositions and enhance their appearance from the perspective of a consumer or other end user. Known coloring agents. e.g., pigments and dyes including CI Direct dyes as well as FD&C approved colorants may be incorporated in the compositions in any effective amount to improve or impart to compositions a desired appearance or color. Such a coloring agent or coloring agents may be added in a conventional fashion, i.e., admixing to a composition or blending with other constituents used to form a composition. The inclusion of a coloring agent is frequently desired in that such provides improved visibility of the both the concentrate composition as well as, to a lesser extent, aqueous dilutions of the concentrate compositions and its presence on a surface being treated. Typically such one or more coloring agents are present in amounts not in excess of about 1.5% wt. yet more preferably are not present in amounts in excess of 1% wt. based on the total weight of the concentrate compositions of which they form a part.

The concentrate compositions of the invention may include one or more biodegradable chelating agents as well, which may be included in effective amounts.

The concentrate compositions may include one or more further surfactants selected from anionic, nonionic, cationic, zwitterionic and/or amphoteric surfactants as well, particularly wherein such are selected to be environmentally acceptable. Such one or more further surfactants may be included in any amount which is found to be effective in improving the cleaning efficacy of the diluted concentrate compositions taught herein.

The concentrate compositions may also include certain polymers which may improve the surface appearance characteristics of hard surfaces treated by dilutions of the concentrated compositions taught herein, which polymers include polyacrylates such as a neutralized or partially neutralized polycarboxylic acid having a nominal molecular weight in the range of about 4000-8000, presently commercially available under the tradename Acusol® 445 N (ex. Rohm & Haas), or acrylate/maleate copolymers such as are presently commercially available under the tradename Sokalan® (ex. BASF). When included, such may be present in any effective amount. Advantageously such ceratin polymers may be included in amounts of from about 0.001-5% wt., preferably in an amount of from about 0.001-3% wt. based on the total weigh of the concentrate composition of which it forms a part.

Preservatives may also be added in minor amounts in the concentrated hard surface treatment compositions according to the invention, although such are typically unnecessary. Preservative compositions known in the art including commercially available preparations can be used. Examples of such preservatives compounds include those which are presently commercially available under the trademarks Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservatives are generally added in only minor amounts, i.e., amounts of about 0.5% by weight of the total concentrate composition, more generally an amount of about 0.1% by weight and less, and preferably present in amounts of about 0.05% by weight and less. Typically such preservative constituents are not necessary in the inventive compositions due to their acidic pH.

The concentrated hard surface treatment compositions of the invention may include one or more pH adjusting agents, or compounds which may be use to adjust the pH of the compositions, or to buffer the pH of the compositions of which they form a part. Such may include, e.g. alkaline materials such as carbonates and hydroxides, especially sodium hydroxide.

The concentrated hard surface treatment compositions according to the invention are preferably substantially anhydrous in their composition, which is to be understood as comprising not more than 5% wt. but preferably (in order of increasing preference) not more than 4.75%, 4.5%, 4.25%, 4%, 3.75%, 3.5%, 3.25%, 3%, 2.75%, 2.5%, 2.25%, 2%, 1.75%, 1.5%, 1.25%, 1%, 0.9%, 0.8%, 0.7%, 0.6%, 0.5%, 0.4%, 0.3%, 0.2%, 0.1%, 0.05% by weight, based on the total weight of the concentrated hard surface treatment composition of which water may form a part. Most preferably the concentrated hard surface treatment compositions according to the invention comprise 0% wt. water. It is to be understood that a concentrated hard surface treatment composition may include water which is provided to the composition as a carrier or minor side-product of one or more constituents without being added as a separate constituent. Such a separately added amounts of water are considered "added water" and desirably the concentrated hard surface treatment compositions according to the invention contain no such added water but rather any water present is supplied as a carrier or minor side-product of one or more nonaqueous constituents.

As is noted above, the concentrated hard surface treatment compositions according to the invention are intended to be diluted to form ready to use hard surface treatment compositions which are largely aqueous in nature. The concentrated hard surface treatment compositions may be added to a larger volume of water in order to form a ready to use treatment composition useful for the treatment of hard surfaces, particularly stained hard surfaces, which desirably comprises at least 70% wt., and in order of increasing preference contains 80, 81, 82, 83, 84, 85, 86, 87, 88, 89, 90, 91, 92, 93, 94, 95, 96, 97, 98 and 99% wt. of water. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in both the concentrated compositions of the invention an in aqueous ready to use dilutions of the concentrate compositions according to the invention.

The composition provided according to the invention can be desirably provided as a consumer product in a manually openable and optionally resealable storage container, which may be either rigid, or may be a deformable "squeeze bottle" type dispenser. With regard to the former, such are known to the art and typically comprise a flask or bottle suited for containing a quantity of the liquid composition of the invention which may be dispensed by removing a reusable closure, e.g., a cap, while the latter is also known to the art and typically comprises a deformable bottle, typically formed of a synthetic polymer such a polyolefin (e.g., polyethylene, polypropylene, etc.) or a polyalkylene terephthalate from which the liquid composition is expelled, typically via a nozzle, by a user compressing part of the deformable bottle. Either of the types of storage container described above may be used, although it is to be understood that such demonstrate preferred but non-limiting embodiments. It is clearly to be understood that any suitable storage and/or dispensing container, packaging or vessel may be used with compositions taught herein. Advantageously where the dilutable concentrated hard surface treatment compositions are provided in such a rigid or flexible flask or container, the compositions may be provided in a "single dose" or "multi-dose" form. In the case of the former, a quantity of the dilutable concentrated hard surface cleaning composition is provided which is intended to be fully dispensed from the flask into a larger quantity of water such that the dilutable concentrated hard surface cleaning composition is dissolved or dispersed in the water and forms a ready to use hard surface cleaning product. In the case of the latter, a sufficient quantity of the dilutable concentrated hard surface cleaning composition is provided such that several doses of the dilutable concentrated hard surface cleaning composition may be dispensed from the flask into a larger quantity of water such that the dilutable concentrated hard surface cleaning composition is dissolved or dispersed in the water and forms a ready to use hard surface cleaning product. Ideally a sufficient amount of the dilutable concentrated hard surface cleaning composition is present so that at least 2 or more read to use hard surface cleaning product compositions may be formed before the contents of the flask or other container is exhausted.

According to a particularly preferred embodiment the dilutable concentrated hard surface cleaning composition is provided in a unit dosage form, such as in a vessel or container wherein such a unit dosage form is dissolved or dispersed into a pre-measured larger volume of water in order to form a ready to use hard surface treatment composition therefrom. In one such preferred embodiment, the unit dosage form is a quantity of the concentrated hard surface treatment composition encased in container which is at least partially water soluble, such as a water soluble pouch or sachet, or an injection molded or draw molded container or capsule at least one part of which is water soluble, but preferably all of which is water soluble. In such an embodiment, such unit dosage forms of the concentrated hard surface treatment compositions are provided into a larger volume of water, which degrades or dissolved the at least partially water soluble container, releasing the concentrated hard surface treatment composition to the water and thereby forming a ready to use hard surface treatment composition therefrom.

A particularly preferred aspect of the invention is the provision of the concentrated hard surface cleaning composition as described herein which is packaged in a water soluble container. The water soluble container may take the form of a flexible bag, pouch, sachet or packet, or may take the form of a more rigid article based on a thermoformed or injection molded water soluble polymer. Such containers are described, for example, in EP-A-524721, GB-A-2244258, WO 92/17381 and WO 00/55068.

The method of thermoforming the water soluble container is preferably one which is similar to the process described in WO 92/17382. According to said process, a first poly (vinyl alcohol) ("PVOH") film is initially thermoformed to produce a non-planar sheet containing a pocket, such as a recess, which is able to retain the aqueous composition. The pocket is generally bounded by a flange, which is preferably substantially planar. The pocket may have internal barrier layers as described in, for example, WO 93/08095. The pocket is then filled with the aqueous composition, and a second PVOH film is placed on the flange and across the pocket. The second PVOH film may or may not be thermoformed. If the first film contains more than one pocket, the second film may be placed across all of the pockets for convenience. The pocket may be completely filled, or only partly filled, for example to leave an air space of from 2 to 20%, especially from 5 to 10%, of the volume of the container immediately after it is formed. Partial filling may reduce the risk of rupture of the container if it is subjected to shock and reduce the risk of leakage if the container is subjected to high temperatures.

The films are then sealed together, for example by heat sealing across the flange. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

For injection molding the containers of the present invention, the container or capsule generally comprises a receptacle part which holds the composition and a closure part, which may simply close the receptacle part or may itself have at least some receptacle function. The receptacle part preferably has side walls which terminate at their upper end in an outward flange in which the closure part is sealingly secured, especially if the closure part is in the form of a film. The securement may be by means of an adhesive but is preferably achieved by means of a seal, between the flange and the closure part. Heat sealing may be used or other methods such as infra-red, radio frequency, ultrasonic, laser, solvent, vibration or spin welding. An adhesive such as an aqueous solution of PVOH or a cellulose ether may also be used. The seal is desirably also water-soluble.

The closure part may itself be injection molded or blow molded. Preferably, however, it is a plastic film secured over the receptacle part. The film may, for example, comprise PVOH or a cellulose ether such as HPMC or another water-soluble polymer.

The container walls may have thicknesses such that the containers are rigid. For example, the outside walls and any inside walls which have been injection molded independently generally have a thickness of greater than 100 μm, for example greater than 150 μm or greater than 200 μm, 300 μm or 500 μm. Preferably, the closure part is of a thinner material than the receptacle part. Thus, typically, the closure part is of thickness in the range 10 to 200 μm, preferably 50 to 100 μm, and the wall thickness of the receptacle part is in the range 300 to 1500 μm, preferably 500 to 1000 μm. The closure part may, however, also have a wall thickness of 300 to 1500 μm, such as 500 to 1000 μm.

Preferably, the closure part dissolves in water (at least to the extent of allowing the washing composition in the receptacle part to be dissolved by the water; and preferably completely) at 20° C. in less than 3 minutes, preferably in less than 1 minute.

The receptacle part and the closure part may be of the same thickness or may be thicker; when thicker the closure part may, for example, be of higher solubility than the receptacle part, in order to dissolve more quickly.

In the manufacturing method, the array, formed by injection molding, is fed to a filling zone, and all the receptacle parts are charged with the concentrated hard surface treatment composition. A sheet of a water-soluble polymer such as PVOH or a cellulose ether may then be secured over the top of the array, to form the closure parts for all the receptacle parts of the array. The array may then be split up into the individual articles or capsules, prior to packaging, or it may be left as an array, for packaging, to be split by the user. Preferably, it is left as an array, for the user to break or tear off the individual capsules. Preferably, the array has a line of symmetry extending between capsules, and the two halves of the array are folded together, about that line of symmetry, so that closure parts are in face-to-face contact. This helps to protect the closure parts from any damage, between factory and user. It will be appreciated that the closure parts are more prone to damage than the receptacle parts. Alternatively two identical arrays of washing capsules may be placed together with their closure parts in face-to-face contact, for packaging.

In all cases, the polymer is formed into a container or receptacle such as a pouch or sachet which can receive the composition, which is filled with the composition and then sealed, for example by heat sealing along the top of the container in vertical form-fill-processes or by laying a further sheet of water-soluble polymer or molded polymer on top of the container and sealing it to the body of the container, for example by heat sealing. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

Desirably the water-soluble polymer is polyvinyl alcohol (PVOH) or a water soluble copolymer thereof. The PVOH may be partially or fully alcoholized or hydrolyzed. For example, it may be from 40 to 100% preferably 70 to 92%, more preferably about 88%, alcoholized or hydrolyzed, polyvinyl acetate. When the polymer is in film form, the film may be cast, blown or extruded.

The water-soluble polymer is generally cold water (20° C.) soluble, but depending on its chemical nature, for example the degree of hydrolysis of the PVOH, may be insoluble in cold water at 20° C., and only become soluble in warm water or hot water having a temperature of, for example, 30° C., 40° C., 50° C. or even 60° C. It is preferable that the water soluble polymer is soluble in cold water.

Such water soluble containers find particular use where a unit-dosage form of the concentrated hard surface treatment composition which is then diluted prior to use so to form a ready to use composition which is then used to treat hard surfaces. The water soluble container to be used for hard surface cleaners can take any shape, such as an envelope, sachet, sphere, cylinder, cube or cuboid (i.e. a rectangular parallelepiped whose faces are not all equal) where the base is square, circular, triangular, or oval, but water soluble containers of rounded cuboid or cylindrical shape are preferred;

rounded cuboid for use in, for example, a bucket of water and cylindrical when used as a refill for a trigger bottle. For the rounded cuboid water soluble container, the water soluble container can have dimensions such as, for example, having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The water-soluble container may hold, for example, from 10 to 40 g of the composition, especially from 10 to 25 g of the composition of the present composition. For the cylindrical shape, the water soluble container diameter should be such that the water soluble container fits through the opening of a trigger bottle, generally about 2 cm. The length of the water soluble container can be, e.g., about 1 to 12 cm. Such water soluble containers hold about 1 to about 25 g of concentrated hard surface treatment composition. However, it should be understood that there is no theoretical limitation, in either size or shape, and what is suitable will normally be decided upon the basis of the "dose" of the water soluble container's contents, the size of any aperture the water soluble container may have to pass through, and the available means of delivery.

In some embodiments, a single layer film for both the top and bottom of the packet can be used or a laminate film of two or more layers of PVOH or other water soluble film can be used on either the top or bottom or on both top and bottom of the packet. For the cylindrical container, the film can also be single layer or a laminate of two or more layers of PVOH or other water soluble film.

According to a particularly preferred embodiment the water soluble container used to package a quantity of the concentrate composition are in the form of filled sachets or filled pouches which are flexible, and which are dimensioned such that they may be supplied through the filling neck or closure of a bottle and into the interior thereof. Such filled sachets or pouches are preferably formed from water soluble films. Such filled sachets or pouches may define a single interior volume or compartment which contains the concentrated hard surface treatment compositions, or may comprise two or more separate interior volumes at least one of which contains the concentrated hard surface treatment compositions taught herein. The pouch is preferably made of a pouch material which is soluble or dispersible in water, and has a water-solubility of at least 50%, preferably at least 75% more preferably at least 90% and especially preferably is essentially completely water soluble in deionized water at 20° C.

Preferred pouch materials are polymeric materials, preferably polymers which are formed into a film or sheet. The pouch material can, for example, be obtained by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material is at least 60%. The polymer can have any weight average molecular weight, preferably from about 1000 to about 1,000,000, more preferably from about 0,000 to about 300,000 yet more preferably from about 20,000 to about 150,000.

Mixtures of polymers can also be used as the pouch material. By way of non-limiting examples, suitable mixtures include for example mixtures wherein one polymer has a higher water-solubility than another polymer, and/or one polymer has a higher mechanical strength than another polymer. Mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000 may also be used. The use of such polymer mixtures can be beneficial to control the mechanical and/or dissolution properties of the pouch, depending on the application thereof and the required needs.

Further suitable for use in the herein are polymer blend compositions, for example comprising hydrolytically degradable and water-soluble polymer blends such as polylactide and polyvinyl alcohol, obtained by mixing polylactide and polyvinyl alcohol, e.g., comprising about 1-35% by weight polylactide and about 65% to 99% by weight polyvinyl alcohol. Preferred for use herein are polymers which are from about 60% to about 98% hydrolyzed, preferably about 80% to about 90% hydrolyzed, to improve the dissolution characteristics of the material.

The pouch material herein can also comprise one or more additive ingredients. For example, it can be beneficial to add plasticisers, for example glycerol, ethylene glycol, diethyleneglycol, propylene glycol, sorbitol and mixtures thereof. Such may be incorporated into the polymeric materials from which the flexible bags, pouches, sachets, or less flexible thermoformed or injection molded containers used to contain the concentrated hard surface treatment compositions are made.

By way of non-limiting examples are commercially available water soluble films such as those sold under the tradename Monosol® (ex. Chris-Craft Industrial Products), the K-series of films (ex. Aicello) as well as water-soluble films presently marketed by Kuraray.

Advantageously, when the water soluble container is in the form of a bag, pouch or sachet, said water soluble container can be, e.g., about 1 to 12 cm. Such water soluble containers should hold about 1 to about 25 g of concentrated hard surface treatment composition. However, it should be understood that there is no theoretical limitation, in either size or shape, and what is suitable will normally be decided upon the basis of the "dose" of the water soluble container's contents, the size of any aperture the water soluble container may have to pass through, and the available means of delivery.

Although they may be used in their undiluted form as a composition for the cleaning treatment of hard surfaces, the concentrated hard surface treatment compositions described are beneficially diluted to form a diluted cleaning composition therefrom, also referred to as a "ready to use" composition useful a treatment composition to be applied directly to the locus of satins on hard surfaces. Such ready to use compositions may be easily prepared by diluting measured amounts of the concentrated hard surface treatment composition in further amounts of water by the consumer or other end user in certain weight ratios of composition to water, and optionally, agitating the same to ensure even distribution of the concentrated hard surface treatment composition in the water. Generally better results and faster removal are to be expected at lower relative dilutions of the composition and the water. Preferred dilution ratios of the concentrated hard surface cleaning composition: water of 1:2-100, preferably 1:3-100, more preferably 1:4-100, yet more preferably 1:5-100, still more preferably 1:10-100, and most preferably 1:16-85, on either a weight/weight ("w/w") ratio or alternately on a volume/volume ("v/v") ratio.

In use, a water soluble container containing a concentrated hard surface treatment compositions can be placed into a spray bottle which uses a dip tube and trigger assembly to dispense a liquid, an amount of water (usually from about 16 to 32 ounces, depending upon the bottle and size of the water soluble container containing the concentrated hard surface cleaning composition) is added to the bottle wherein the water soluble container starts to dissolve. The dip tube with trigger assembly is then reattached to the bottle and the solution formed therein is ready for use. The resulting solution can be used to treat a variety of surfaces, examples of which are described above. In addition, the water soluble container can also be used in conjunction with cleaning systems which comprise a handle, a cleaning head, and a fluid reservoir wherein the fluid reservoir is attached to the handle such that the fluid in the reservoir is dispensed onto a surface to be cleaned adjacent to the cleaning head. In use, the water soluble container is placed into the fluid reservoir, the requisite amount of water is added to the reservoir and the water soluble container dissolves, releasing the concentrated hard surface treatment compositions contained therein to be released into the reservoir. The resulting solution is then a ready to use composition and may be used in the cleaning system. Examples of cleaning systems include those described in, for example, WO 01/72195; WO 01/22861; WO 00/27271; WO 98/42246; DE 3940123; and U.S. Pat. No. 5,888,006, the contents of which are incorporated by reference.

Particularly preferred compositions of the present invention will have good cleaning properties and provide a germicidal and/or disinfecting and/or sanitizing benefit to hard surfaces treated with ready to use compositions formed by the dilution or dispersion of the concentrated hard surface treatment compositions of the invention in a measured amount of water.

The concentrated hard surface treatment compositions and ready to use compositions formed therefrom are advantageously used in the cleaning treatment of hard surfaces, as the hard surface cleaning composition according to the invention is desirably provided as a ready to use product which may be directly applied to a hard surface. By way of non-limiting examples, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone.

The concentrate compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

Illustrative example compositions which were produced include those set forth below. The illustrative example composition demonstrates preferred embodiments of the invention as well as preferred weight percentages as well as preferred relative weight percentages/weight ratios with regard to the respective individual constituents present within the composition.

EXAMPLES

Examples the inventive concentrated hard surface treatment compositions are described in the following Table 1; the constituents indicated on Table 1 used to produce the formulations were used on an "as supplied" basis; the identity of these constituents are disclosed in more detail on Table 2. The concentrated hard surface treatment compositions were produced by mixing the constituents outlined in Table 1 in a beaker at room temperature which was stirred with a conventional magnetic stirring rod or paddle mixer; stirring continued until the formulation was homogenous in appearance. It is to be noted that the constituents might be added in any order, but it is preferred that a first premixture is made of any fragrance constituent with one or more surfactants used in the inventive concentrated hard surface treatment compositions. The order of addition is not critical, but good results are obtained where the surfactants (which may be also the premixture of the fragrance and surfactants) are produced prior to the remaining constituents. The amounts of the named constituents are indicated in % w/w based on a total weight of the concentrated hard surface treatment composition of which they form a part. The total amount of water present in each composition was based on the amount of water provided via one or more of the named constituents; no water was added to the compositions as a separate constituent.

Table C1 illustrates a series of "comparative examples" which were made in a similar manner to those described on Table 1. The constituents indicated on Table C1 were used on an "as supplied" basis; the identity of these constituents are disclosed in more detail on Table 2.

TABLE 1

| | E1 | E2 | E3 | E4 | E5 | E6 |
|---|---|---|---|---|---|---|
| Tomadol 91-6 | 20 | 21.06 | 19.6 | 19.7 | 11.5 | 18.0 |
| Biosoft S-101 (96%) | 12.57 | 12.03 | 12.36 | 12.4 | 20.16 | 16.75 |
| Biosoft N-411 (90%) | — | — | — | — | — | — |
| lactic acid (88%) | 36.36 | 34.8 | 35.77 | 35.88 | 35.01 | 36.36 |
| monoethanolamine | 3.2 | 2.92 | 3.44 | 3.16 | 5.15 | 4.28 |
| Dowanol DPnB | 18.0 | 28.2 | 27.5 | 17.76 | 17.33 | 16.3 |
| Dowanol PPH | 8.67 | — | — | 9.86 | 9.63 | 7.1 |
| fragrance | 1.0 | — | 1.32 | 1.0 | 1.0 | 1.0 |
| colorant | 0.004 | 0.004 | 0.008 | 0.004 | 0.005 | 0.004 |
| total water | 4.61 | 4.22 | 4.34 | 4.59 | 4.44 | 4.64 |

TABLE C1

| | C1 | C2 | C3 | C4 | C5 | C6 | C7 | C8 | C9 | C10 | C11 |
|---|---|---|---|---|---|---|---|---|---|---|---|
| Tomadol 91-6 | 10.0 | 11.0 | 11.0 | 11.0 | 11.0 | 16.67 | 34.0 | 15.73 | 26.0 | 20.4 | 26.0 |
| Alfonic 810-4.5 | — | — | — | 3.0 | 3.5 | — | — | — | — | — | — |
| Ammonyx LO (30%) | — | — | — | — | — | 6.67 | — | — | — | — | — |
| Glucopon 425N | — | — | — | — | — | — | — | — | — | — | 12.0 |
| Genapol LA 070S | — | — | — | — | — | — | — | 10.0 | — | — | — |
| Pluronic L64 | — | — | — | — | — | — | — | — | — | 4.0 | — |
| Biosoft S-101 (96%) | — | — | — | — | — | — | — | — | — | — | — |
| Biosoft N-411 (90%) | — | — | — | — | — | — | — | — | — | — | — |
| Hostapur SAS 60 (60%) | — | — | 11.67 | 6.67 | — | — | 13.33 | 8.2 | — | 13.25 | — |
| Steol CS-460 (60%) | 9.33 | 11.68 | — | — | — | — | — | — | — | — | — |
| Stepanol WA-100 (99%) | — | — | — | — | — | — | — | — | 10.1 | — | — |
| Dowfax 3B2 (45%) | — | — | — | — | 8.93 | 6.67 | — | — | — | — | — |
| lactic acid (88%) | 37.5 | 56.5 | 56.82 | 62.5 | 56.82 | 45.45 | 36.36 | 35.57 | 36.17 | 33.7 | 35.27 |
| monoethanolamine | — | — | — | 2.0 | — | — | 2.0 | — | — | — | 1.5 |
| Dowanol DPnB | — | — | — | — | — | — | — | — | — | 27.8 | 15.98 |
| Dowanol PPH | — | — | — | — | — | — | — | — | — | — | 8.0 |
| Dowanol PnB | 32.5 | 13.0 | 12.5 | 10.0 | 10.0 | 22.0 | 13.1 | 29.5 | 26.53 | — | — |
| Dowanol PM | — | 5.0 | 5.5 | 4.0 | 5.5 | — | — | — | — | — | — |
| propylene glycol | 8.0 | — | — | — | 1.0 | — | — | — | — | — | — |
| NaOH (50%) | 1.62 | 1.62 | 1.62 | — | 1.62 | — | — | — | — | — | — |
| fragrance | 1.04 | 1.2 | 0.89 | 0.83 | 1.65 | 0.94 | 1.2 | 1.0 | 1.2 | 0.85 | 1.25 |
| colorant | 0.002 | 0.003 | — | — | — | 0.003 | 0.006 | 0.006 | 0.008 | 0.004 | 0.004 |
| total water | 8.11 | 10.28 | 12.3 | 10.17 | 12.42 | 9.91 | 9.7 | 7.54 | 4.34 | 9.34 | 10.20 |

All of the formulations on the foregoing Table 1 is indicated in weight percent, and each composition comprised 100% wt. The individual constituents were used, "as-supplied" from their respective source and unless otherwise indicated, each of the constituents are to be understood as being "100% wt. actives". Deionized water was added in quantum sufficient, "q.s.", to provide the balance to 100% wt. of each of the example compositions. The sources of the constituents used in the formulations of Tables 1 are described on the following Table 2.

TABLE 2

| | |
|---|---|
| Tomadol 91-6 | $C_9$-$C_{11}$ linear alcohol ethoxylate, 6 EO (average) (100% wt. actives) ex. Tomah |
| Alfonic 810-4.5 | $C_8$-$C_{10}$ linear alcohol ethoxylate, 4.5 EO (average) (100% wt. actives) |
| Ammonyx LO (30%) | lauryl dimethyl amine oxides (30% wt. actives) ex. Stepan Co. |
| Glucopon 425N (50%) | alkylpolyglucoside based nonionic surfactant (50% wt. actives) |
| Genapol LA 070S | $C_{12}$-$C_{16}$ fatty alcohol polyglycol ether, 7 EO (average) (100% wt. actives) ex. Clariant (Muttenz, CH) |
| Pluronic L64 | ethylene oxide/propylene oxide block copolymer based nonionic surfactant, 2900 avg. molecular weight (100% wt. actives) ex. BASF |
| Biosoft S-101 (96%) | alkylbenzene sulfonic acid (96% wt. actives) |
| Hostapur SAS 60 (60%) | sodium $C_{14}$-$C_{17}$ secondary alkyl sulfonate (60% wt. actives) |
| Steol CS-460 (60%) | sodium lauryl ether sulfate (60% wt. actives) ex. Stepan Co. |
| Stepanol WA-100 (99%) | sodium lauryl ether sulfate (99% wt. actives) |
| Dowfax 3B2 (45%) | diphenyl oxide disulfonate, 45% wt. active, (ex. Dow Chemical Co.) |
| NaOH (50%) | aqueous sodium hydroxide solution (50% wt. actives) |
| lactic acid (88%) | aqueous lactic acid, 88% wt. actives |
| monoethanolamine | monoethanolamine (100% wt. actives) |
| Dowanol DPnB | dipropylene glycol n-butyl ether (100% wt. actives) ex. Dow Chemical Co. |
| Dowanol PPH (93%) | propylene glycol phenyl ether (100% wt. actives) ex. Dow Chem. Co. |
| Dowanol PnB | propylene glycol n-butyl ether (100% wt. actives) ex. Dow Chem. Co. |

TABLE 2-continued

| | |
|---|---|
| Dowanol PM | propylene glycol methyl ether (100% wt. actives) ex. Dow Chem. Co. |
| propylene glycol | propylene glycol (100% wt. actives) |
| fragrance | fragrance composition, proprietary composition of its supplier |
| colorant | aqueous dispersion of a C.I. Acid Dye |
| di water | deionized water |

Several of the foregoing compositions were tested and evaluated according to one or more of the following test protocols.

Cleaning of Organic Soil (Greasy Wallboard):

Cleaning evaluations of certain of the compositions described on Table 1 and C1 were performed in accordance with the testing protocol outlined according to ASTM D4488 A2 Test Method, which evaluated the efficacy of the cleaning compositions in removing a standardized greasy organic soil on masonite wallboard samples painted with white wall paint. Prior to the test, the tested compositions of Table 1 and C1 were diluted at 1 part of the indicated composition with 31 ounces of tap water from a municipal water supply to form a ready to use composition therefrom.

The soil applied was a standardized greasy soil containing:

| Test Greasy Soil | % w/w |
|---|---|
| vegetable oil | 33 |
| vegetable shortening | 33 |
| lard | 33 |
| carbon black | 1 |

which were blended together to homogeneity under gentle heating to form a uniform mixture which was later allowed to cool to room temperature. The sponge (water dampened) of a Gardner Abrasion Tester apparatus was squirted with a 15 gram sample of a tested cleaning composition, and the apparatus was cycled 2 to 6 times. The test was replicated 4 times for each tested composition. the cleaning efficacy of the tested compositions was evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

The results of this evaluation was averaged for each of the tested compositions, and the results of the evaluation are reported on the following Table 3.

TABLE 3

| Greasy Wallboard | |
|---|---|
| | % Removal |
| E1 | 74.78 |
| E2 | 73.5 |
| E3 | 75.4 |
| E4 | 75.4 |
| E5 | 76.9 |
| E6 | 76.4 |
| C1 | 35.3 |
| C2 | 38.16 |
| C3 | 36.42 |
| C4 | 37.45 |
| C5 | 35.60 |
| C6 | 32.30 |
| C7 | 35.7 |
| C9 | 45.51 |
| C10 | 38.5 |
| C11 | 36.5 |

As is evidenced from the foregoing results, the ready to use compositions formed from the comparative examples exhibited much poorer greasy cleaning performance as compared to the ready to use compositions formed from the concentrated hard surface treatment compositions of Table 1.

Storage Stability

A quantity of a composition according to E1 was contained in pouches formed from a thermoformed polyvinyl alcohol film, and was subjected to a storage stability test wherein a set of pouches was maintained in a sealed barrier container at 40° C. for 12 weeks, while a further set of pouches were maintained in a sealed barrier container at 50° C. for 12 weeks. Subsequently the pouches were removed and allowed to cool to room temperature (approx. 20° C.) and were separately diluted in a larger volume of tap water from a municipal water supply, no insoluble residues were observed after the pouches were permitted to dissolve.

Antimicrobial Efficacy

The a dilution of 1 part of the concentrate composition "E1" of Table 1 in 31 parts of a "standardized" hard water having 200 ppm of $CaCO_3$ was evaluated in order to evaluate its antimicrobial efficacy against *Staphylococcus aureus* (gram positive type pathogenic bacteria) (ATCC 6538), and *Pseudomonas aeruginosa* (ATCC 15442). The testing was performed in accordance with the protocols outlined in AOAC Official Method 961.02 "Germicidal Spray Products as Disinfectants", as described in AOAC Official Methods of Analysis, 16th Ed., (1995).

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (slides) evaluated in accordance with the AOAC Germicidal Spray Test. Thus, a result of "0/20" indicates that of 20 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the testing are indicated on Table 5, below. The reported results indicate the number of test cylinders with live test organisms/number of test cylinders tested for each example formulation and organism tested.

TABLE 4

| | $Log_{10}$ reduction E1 |
|---|---|
| *Staphylococcus aureus* | 0/20 |
| *Pseudomonas aeruginosa* | 0/20 |

As is readily evident from the results reported on Table 4, the compositions of the invention provided excellent antimicrobial benefits.

As may be seen from the results indicated above, the compositions according to the invention provide excellent cleaning benefits to hard surfaces, including hard surfaces with difficult to remove greasy soil stains, excellent storage stability when the concentrated hard surface treatment compositions are packaged in water soluble pouches or sachets, and also excellent antimicrobial efficacy of dilutable ready-to-use compositions formed from such concentrates, where such ready-to-use compositions are effective against known bacteria commonly found in bathroom, kitchen and other environments. Such advantages clearly illustrate the superior characteristics of the compositions, the cleaning and antimicrobial benefits attending its use which is not before known to the art.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. A dilutable concentrated hard surface treatment composition provided in a water soluble package which composition comprises :

a detersive anionic surfactant in acid form, such that the detersive anionic surfactant in acid form in situ reacts with an alkanolamine present in the concentrated hard surface cleaning compositions to form an alkanolamine form of the detersive anionic surfacant;

an alkanolamine, wherein the weight ratio of the detersive anionic surfactant to the alkanolamine is 3.95-3.45:1 an organic solvent constituent which includes at least one glycol ether solvent having reduced aqueous solubility, and at least one glycol ether solvent having good aqueous solubility;

between 25 wt % and 75 wt % of an organic acid constituent which comprises at least one monocarboxylic acid;

optionally a nonionic cosurfactant not in excess of 30 wt %;

optionally, one or more constituents directed to improving the aesthetic or functional features to the compositions ; and, wherein the concentrated hard surface treatment composition comprises 5% wt. or less of water.

2. A dilutable concentrated hard surface treatment composition according to claim 1 wherein the monocarboxylic acid comprises lactic acid.

3. A ready to use hard surface treatment composition comprising an aqueous dilution of the concentrated hard surface treatment composition according to claim 1.

4. A process for the cleaning treatment of hard surfaces, and optionally the disinfecting and/or germicidal and/or sanitizing of hard surfaces, which process includes the step of:

applying to said hard surface a cleaning effective amount of a hard surface treatment composition according to claim 1.

5. A water soluble pouch or a water soluble sachet containing a dilutable concentrated hard surface treatment composition which comprises:

a detersive anionic surfactant in acid form, such that the detersive anionic surfactant in acid form reacts in situ with an alkanolamine present in the concentrated hard surface cleaning compositions to form an alkanolamine form of the detersive anionic surfacant;

an alkanolamine, wherein the weight ratio of the detersive anionic surfactant to the alkanolamine is 3.95-3.45:1 an organic solvent constituent which includes at least one glycol ether solvent having reduced aqueous solubility, and at least one glycol ether solvent having good aqueous solubility;

an organic acid between 25 wt % and 75 wt % of constituent which comprises at least one monocarboxylic acid;

a nonionic cosurfactant not in excess of 30% wt;

optionally, one or more constituents directed to improving the aesthetic or functional features of the compositions; and, 5% wt. or less of water.

6. A water soluble pouch or a water soluble sachet according to claim 5, wherein the monocarboxylic acid is lactic acid.

7. A ready to use hard surface treatment composition comprising an aqueous dilution of the concentrated hard surface treatment composition according to claim 5.

8. A water soluble pouch or a water soluble sachet containing a dilutable concentrated hard surface treatment composition which consists essentially of:

a detersive anionic surfactant in acid form, such that the detersive anionic surfactant in acid form reacts in situ with an alkanolamine present in the concentrated hard surface cleaning compositions to form an alkanolamine form of the detersive anionic surfacant;

an alkanolamine, wherein the weight ratio of the detersive anionic surfactant to the alkanolamine is 3.95-3.45:1 an organic solvent constituent which includes at least one glycol ether solvent having reduced aqueous solubility, and at least one glycol ether solvent having good aqueous solubility;

an organic acid between 25 wt % and 75 wt % of constituent which comprises at least one monocarboxylic acid;

a nonionic cosurfactant not in excess of 30% wt.;

optionally, one or more constituents directed to improving the aesthetic or functional features of the compositions; and, 5% wt. or less of water.

9. A water soluble pouch or a water soluble sachet according to claim 8, wherein the monocarboxylic acid is lactic acid.

10. A ready to use hard surface treatment composition comprising an aqueous dilution of the concentrated hard surface treatment composition according to claim 8.

* * * * *